US007308858B2

(12) United States Patent
Lo et al.

(10) Patent No.: US 7,308,858 B2
(45) Date of Patent: Dec. 18, 2007

(54) LOCKING DEVICE FOR FOLDABLE STAND FOR MACHINE AND FOLDABLE STAND FOR MACHINE COMPRISING THE SAME

(75) Inventors: Eric Lo, Taichung (TW); George Ku, Taichung (TW)

(73) Assignee: Rexon Industrial Corp. Ltd., Taichung (TW)

( * ) Notice: Subject to any disclaimer, the term of this patent is extended or adjusted under 35 U.S.C. 154(b) by 359 days.

(21) Appl. No.: 11/017,767

(22) Filed: Dec. 22, 2004

(65) Prior Publication Data

US 2006/0130718 A1 Jun. 22, 2006

(51) Int. Cl.
*A47B 3/00* (2006.01)

(52) U.S. Cl. ..... 108/131; 108/130

(58) Field of Classification Search ..... 108/124, 108/126, 127, 129, 130, 131, 132, 133, 117, 108/115, 120, 167, 168, 169, 171, 172, 173, 108/174; 248/188.6, 439, 166, 158, 150; 144/286.1; 280/47.24
See application file for complete search history.

(56) References Cited

U.S. PATENT DOCUMENTS 992,758 A * 5/1911 Deming ..... 108/132
1,120,702 A * 12/1914 Erdman ..... 108/115
2,003,836 A * 6/1935 Mitchell ..... 108/126
2,202,318 A * 5/1940 Ralson ..... 403/65
2,215,093 A * 9/1940 Boardman ..... 248/188
2,318,945 A * 5/1943 Johannsen ..... 108/133
2,487,401 A * 11/1949 Turner ..... 403/65
3,361,090 A * 1/1968 Howlett ..... 108/33
3,669,031 A * 6/1972 Cole ..... 108/102
4,144,822 A * 3/1979 Roberts et al. ..... 108/129
5,606,922 A * 3/1997 Adams et al. ..... 108/129
6,607,015 B1 * 8/2003 Chen ..... 144/286.1
6,945,178 B1 * 9/2005 Nye et al. ..... 108/132

* cited by examiner

*Primary Examiner*—Janet M. Wilkens
(74) *Attorney, Agent, or Firm*—Browdy and Neimark, PLLC

(57) ABSTRACT

A foldable stand for a machine includes a tabletop, a plurality of legs each having one end pivotally mounted to the tabletop such that the legs are turnable relative to the tabletop between an extended position and a received position, a plurality of first locking members each having a body portion movably pivotally mounted to the worktop and a stop portion protruded from the body portion for stopping against the legs so as to lock the legs in the extended position, and a plurality of second locking members respectively mounted in the tabletop for locking the legs in the received position.

21 Claims, 6 Drawing Sheets

LOCKING DEVICE FOR FOLDABLE STAND FOR MACHINE AND FOLDABLE STAND FOR MACHINE COMPRISING THE SAME

BACKGROUND OF THE INVENTION

1. Field of the Invention

The present invention relates generally to a stand for supporting a machine, such as a circular sawing machine, and more particularly, to a foldable stand for a machine that enables the user to lock the legs in the extended position or the received position. The invention relates also to a locking device for use in a foldable stand for a machine to lock the legs in the extended position or the received position.

2. Description of the Related Art

U.S. Pat. No. 6,607,015 discloses a foldable stand for a circular sawing machine. The disclosed foldable stand comprises a tabletop, two H-shaped legs respectively pivotally attached to the tabletop, a first attachment member pivotally mounted on each H-shaped leg and connected to a corresponding bracket at the tabletop, and a second attachment member. The first attachment member includes a hook formed on the bottom of each of the corresponding brackets, a lever pivotally attached to one side of each of the legs and corresponding to the hook, and a U-shaped loop pivotally attached to the lever and selectively connected to the hook. The U-shaped loop has two opposite ends respectively pivotally connected to opposite sides of the lever. The second attachment member comprises a hook securely attached to an inner side of one of the two legs, a lever pivotally attached to the tabletop and corresponding to the hook of the second attachment member, and a loop pivotally attached to the lever of the second attachment and selectively connected to the hook of the second attachment member. This design of foldable stand is functional, however its structure is complicated. Further, the protruding hooks may hurt the user accidentally. Further, it is complicated to lock the foldable stand between the extended operative condition and the received non-operative condition. If the user employs an extensive load to the lever in a rush when operating the lever to lock the corresponding hook and loop, the loop may be damaged or forced away from the lever.

SUMMARY OF THE INVENTION

The present invention has been accomplished under the circumstances in view. It is the primary objective of the present invention to provide a simple, strong, easy-to-operate locking device, which is practical for use in a foldable stand for a machine to lock the legs in the extended position or the received position.

It is another objective of the present invention to provide a foldable stand for a machine comprising such a simple, strong, easy-to-operate locking device To achieve one of the above-mentioned objectives of the present invention, the locking device is used in a foldable stand having a tabletop and a plurality of legs turnable relative to the tabletop between an extended position and a received position for selectively locking the legs to the tabletop between the extended position and the received position. The locking device comprises a first locking member for movably mounting in the tabletop and for stopping against the leg so as to lock the leg in the extended position, and a second locking member for mounting in the tabletop and for locking the leg in the received position.

According to a preferred embodiment of the present invention, the first locking member comprises a body portion for pivotally and movably mounting to the tabletop through a pivot, a stop portion protruded from a periphery of the body portion, and a flat handle outwardly extended from the periphery of the body portion for pulling by a user to turn the body portion relative to the tabletop and to further force the stop portion against the leg.

In another preferred embodiment of the present invention, the first locking member comprises a body portion insertable into the leg, and a finger strip outwardly extending from a periphery of the body portion for pulling by a user to engage the body portion into the leg to lock the leg in the extended position.

According to a preferred embodiment of the present invention, the second locking member is a hook member pivotable to the tabletop for hooking on the leg to lock the leg in the received position.

In a preferred embodiment of the present invention, the second locking member is a spring plate fixedly fastened to the tabletop for stopping against the leg to hold the leg in the received position after movement of the leg to the received position.

To achieve another one of the above-mentioned objectives of the present invention, a foldable stand for a machine according to the present invention comprises a tabletop, a plurality of legs each having an end pivotally mounted to the tabletop such that the legs are turnable relative to the tabletop between an extended position and a received position, a plurality of first locking members respectively movably mounted in the tabletop for stopping against the legs to lock the legs in the extended position, and a plurality of second locking members respectively installed in the tabletop for locking the legs in the received position.

DETAILED DESCRIPTION OF THE INVENTION

Figure 1:
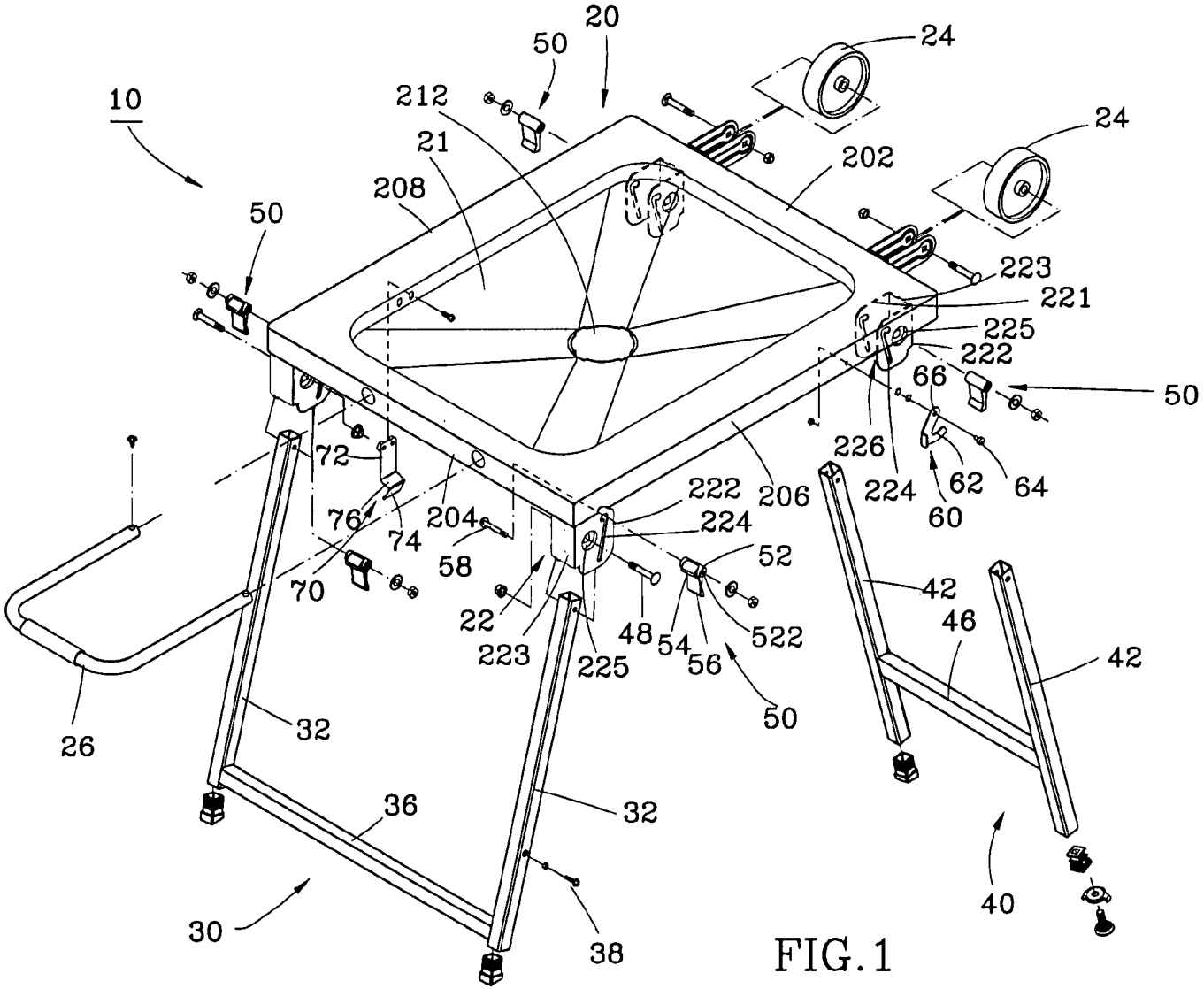
FIG. 1 is an exploded view of a foldable stand for a machine according to a first preferred embodiment of the present invention.
Figure 2:
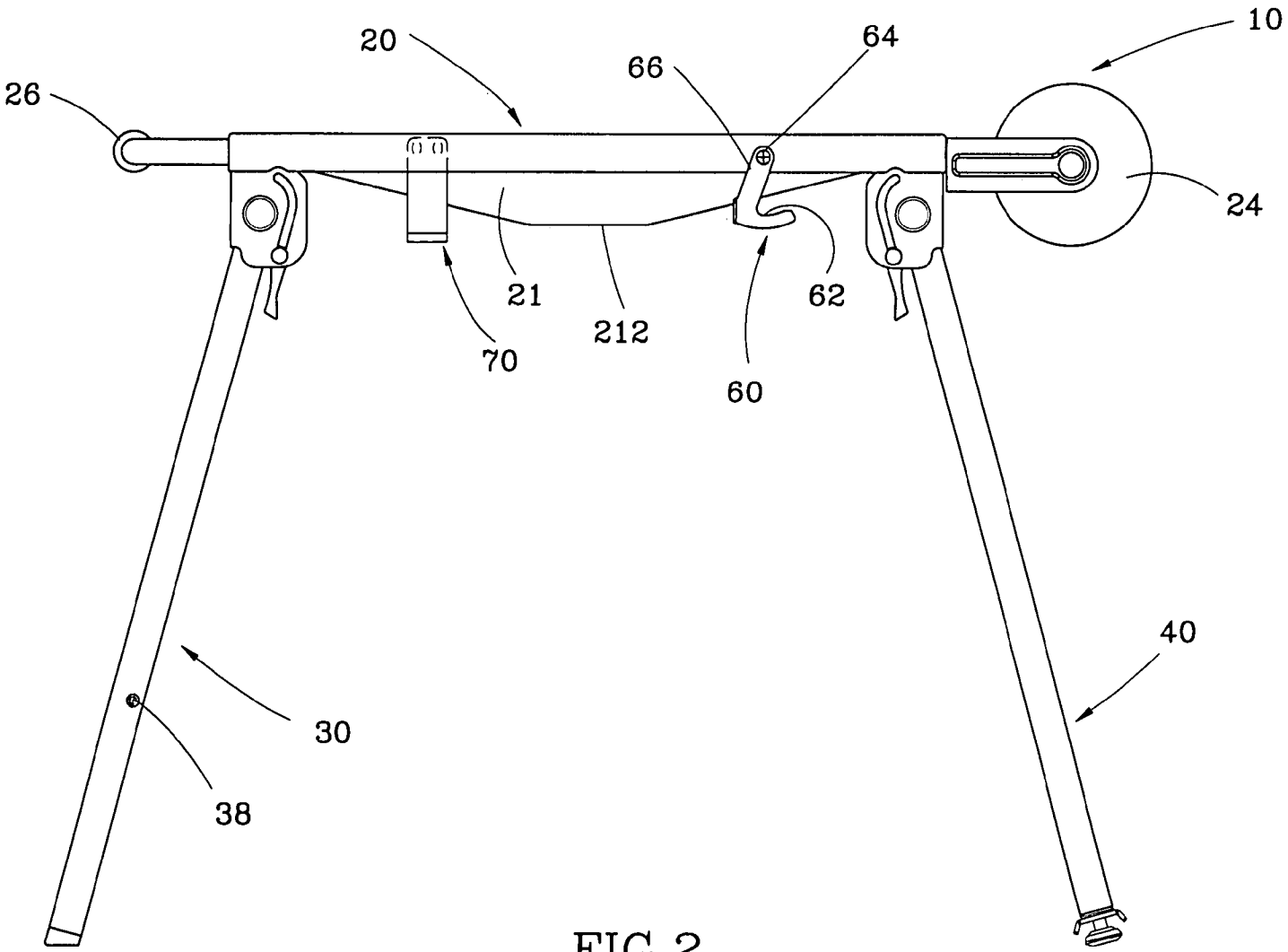
FIG. 2 is a side view of the first preferred embodiment of the present invention, showing the stand set in the extended position.

Referring to FIGS. 1-4, a foldable stand 10 in accordance with the first preferred embodiment of the present invention is shown comprised of a tabletop 20, a first leg frame 30, a second leg frame 40, and a locking device including four first locking members 50 respectively provided between the tabletop 20 and the leg frames 30 and 40, and two second locking members, namely, the right second locking member 60 and the left second locking member 70.

Figure 4:
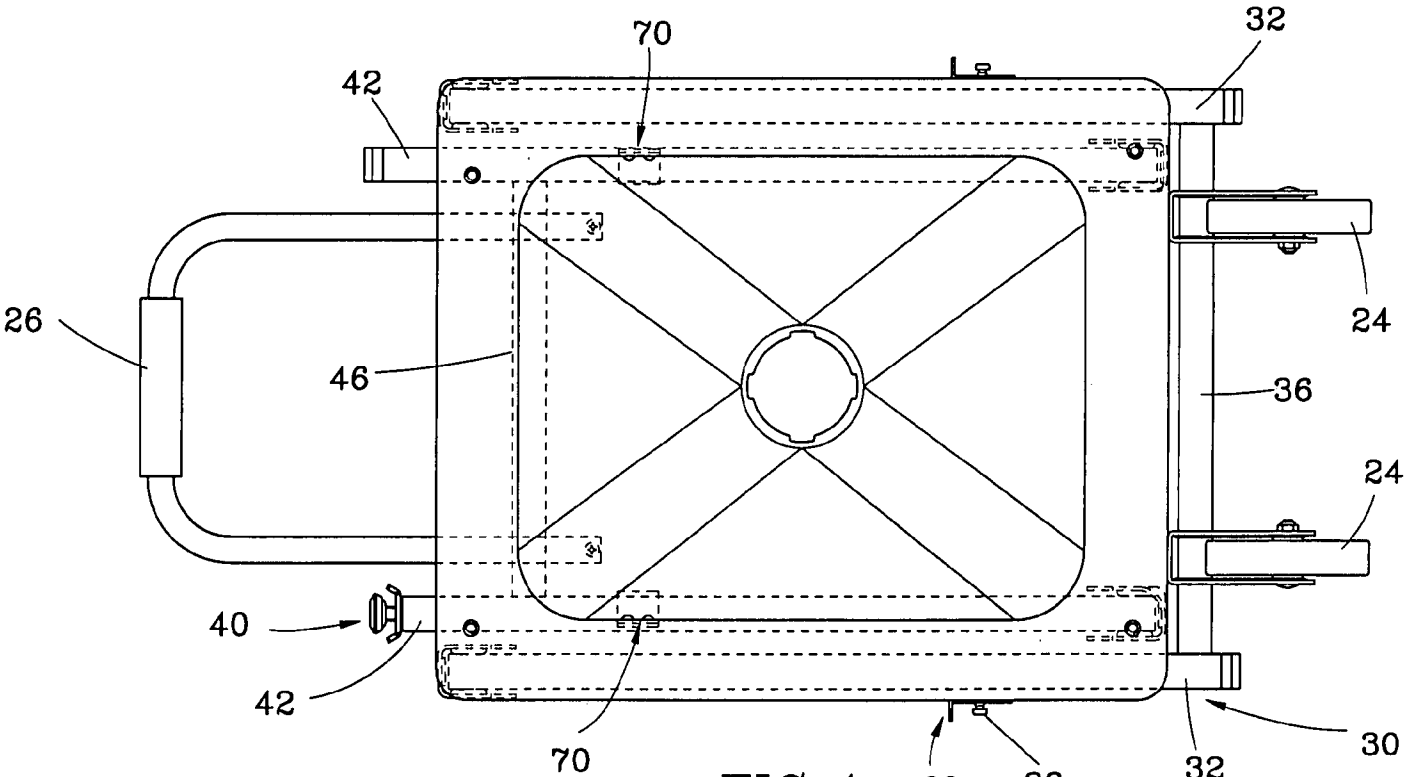
FIG. 4 is a top view of the first preferred embodiment of the present invention, showing the stand set in the received position.

The tabletop 20 is a rectangular frame member for supporting a machine, for example, circular saw (not shown), having a center area curved inwards and forming a conical dust collection portion 21, a through hole 212 vertically cut through the center of the conical dust collection portion 21 and connected to a dust collector (not shown) for carrying collected cutting dust away from the tabletop 20. The tabletop 20 comprises four brackets 22 downwardly extended from the bottom wall in the four corners, two wheels 24 pivotally attached to the rear edge 202, and a U-shaped handle 26 inserted through the front edge 204. After the leg frames 30 and 40 have been received and locked, the user can hold the handle 26 to move the stand 10 on the floor by means of the wheels 24. Further, each bracket 22 comprises a first sidewall 221, a second sidewall 222 opposing the first sidewall 221, and a third sidewall 223 joining the first sidewall 221 and the second sidewall 222. The first sidewall 221 and the second sidewall 222 each have a corresponding downwardly extending arched sliding slot 224 and a corresponding through hole 225. The three sidewalls 221-223 of each bracket 22 surround a receiving chamber 226. As shown in FIGS. 1 and 4, the distance between the two brackets at the bottom side of the front edge 204 of the tabletop 20 is greater than the distance between the two brackets at the bottom side of the rear edge 202.

Figure 3:
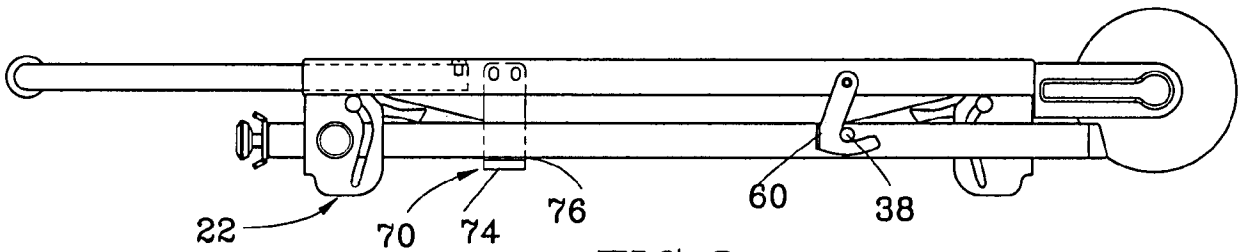
FIG. 3 is a side view of the first preferred embodiment of the present invention, showing the stand set in the received position.

The first leg frame 30 comprises two parallel vertical legs 32, a transverse bar 36 connected between the vertical legs 32, and a peg 38 formed of a screw and fastened to one vertical leg 32. The second leg frame 40 comprises two parallel vertical legs 42 and a transverse bar 46 connected between the vertical legs 42. The length of the transverse bar 46 is shorter than the transverse bar 36. According to this preferred embodiment, four screw bolts 48 are respectively inserted through the through holes 225 of the brackets 22 and the top ends of the vertical legs 32 and 42 to pivotally secure the top ends of the vertical legs 32 and 42 of the leg frames 30 and 40 to the corresponding receiving chambers 226 of the brackets 22 such that the legs 32 and 42 can be turned relative to the tabletop 20 between the extended position (see FIGS. 1 and 2) and the received position (see FIGS. 3 and 4). As shown in FIGS. 3 and 4, when received the first leg frame 30 and the second leg frame 40, the second leg frame 40 is set between the two vertical legs 32 of the first leg frame 30, i.e., the legs 32 and 42 do not interfere with each other.

Figure 5A:
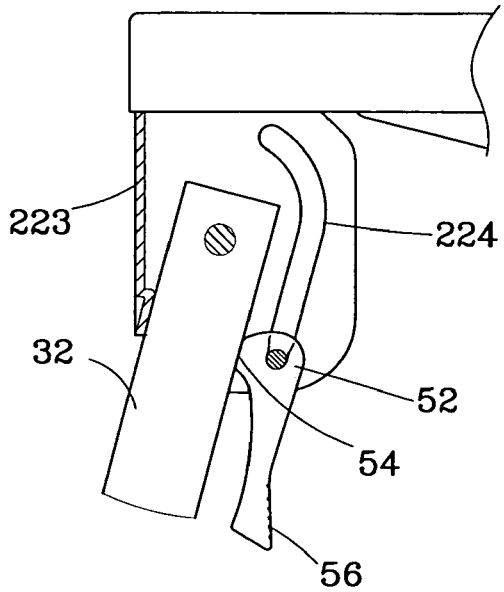
FIGS. 5A-5D are schematic drawings showing the leg of the first leg frame moved from the extended position to the received position according to the present invention.
Figure 5B:
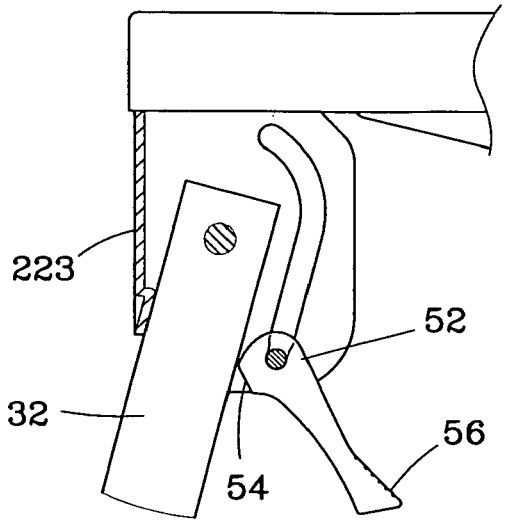
Figure 5C:
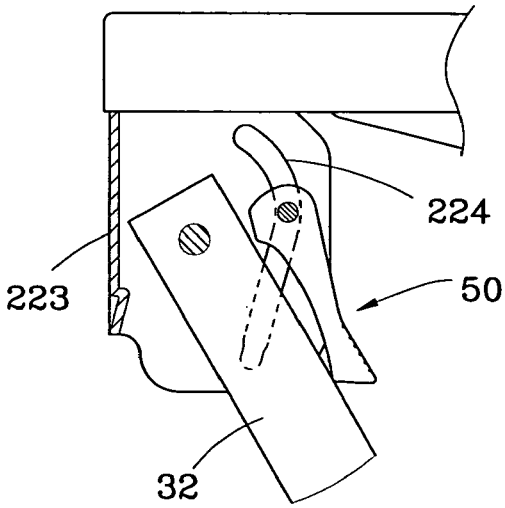
Figure 5D:
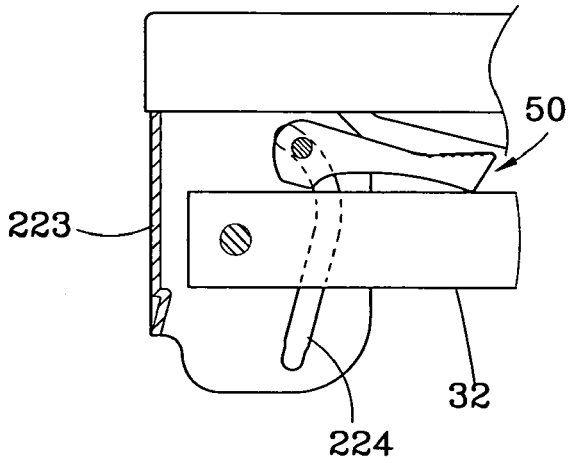

Each first locking member 50 comprises a rod-like body portion 52, a pivot hole 522 axially extending through two distal ends of the body portion 52, a stop portion 54 protruded from the periphery of the body portion 52, and a flat handle 56 outwardly extended from the periphery of the body portion 52. A pivot 58 is inserted through the pivot hole 522 of one first locking member 50 and the two arched sliding slots 224 of one bracket 20 to pivotally movably secure the respective first locking member 50 to the respective bracket 20, for enabling the body portion 52 to be movable along the respective arched sliding slots 224 and turnable about the pivot 58. As shown in FIG. 5A, when moved the first locking member 50 to the bottom side of the respective arched sliding slots 224 and set the corresponding leg 32 in the extended position, the stop portion 54 is stopped against the corresponding vertical leg 32 to lock the corresponding vertical leg 32 in the extended position. Referring to FIG. 5B, by means of pulling the flat handle 56 to turn the body portion 52 about the corresponding pivot 58 in counter-clockwise direction, the stop portion 54 is disengaged from the corresponding vertical leg 32, for enabling the user to turn the corresponding vertical leg 32 relative to the corresponding bracket 22 from the extended position to the received position, at this time, the corresponding first locking member 50 is forced by the corresponding vertical leg 32 to move along the corresponding arched sliding slots 224 from the bottom side to the top side (see FIGS. 5C-5D). On the contrary, when turning the vertical leg 32 from the received position to the extended position, the corresponding first locking member 50 will forced by its gravity weight to move along the arched sliding slots 224 from the top side to the bottom side, and the user can then pull the flat handle 56 to turn the body portion 52 about the corresponding pivot 58 in clockwise direction to force the stop portion 54 against the corresponding vertical leg 32 and to further lock the corresponding vertical leg 32 in position.

The right second locking member 60 is an L-shaped hook member having a hooked portion 62 and a top end 66 pivotally secured to the right side edge 206 of the tabletop 20 with a screw 64. When moved the first leg frame 30 to the received position, the user can turn the right second locking member 60 to hook the hooked portion 62 on the peg 38 of the first leg frame 30 to lock the first leg frame 30 in the received position.

The left second locking member 70 is a curved spring plate, having a top end 72 affixed to the left side edge 208 of the tabletop 20 with a screw, a bottom guiding face 74, and a substantially horizontal bearing face 76 connected between the top end 72 and the bottom guiding face 74. When moving the second leg frame 40 to the received position, one vertical leg 42 of the second leg frame 40 will contact the left second locking member 70 and will be moved along the bottom guiding face 74 to the horizontal bearing face 76 and stopped at the horizontal bearing face 76 to lock the second leg frame 40 in the received position.

Figure 6:
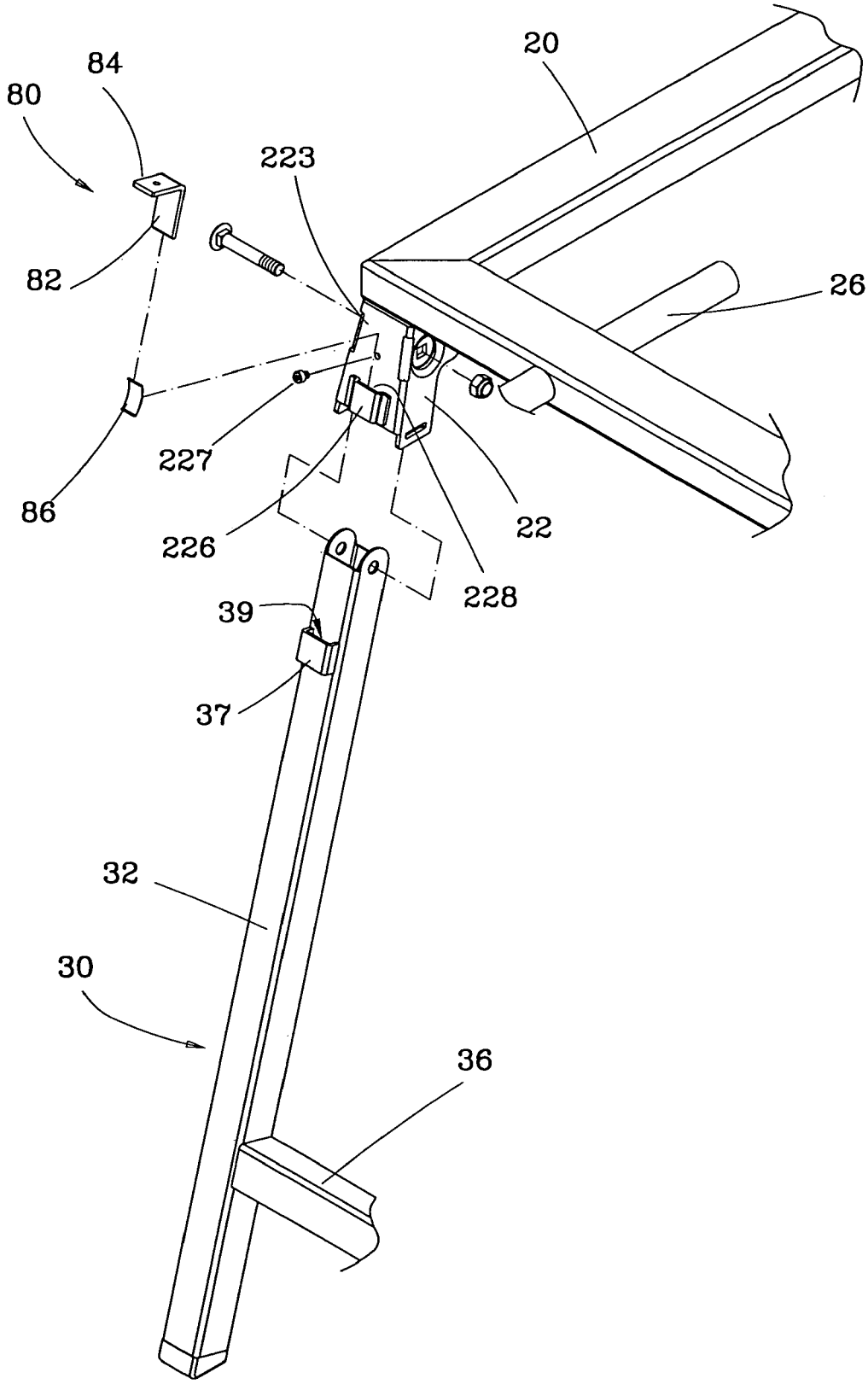
FIG. 6 is an exploded view of a part of a foldable stand for a machine according to a second preferred embodiment of the present invention.
Figure 7:
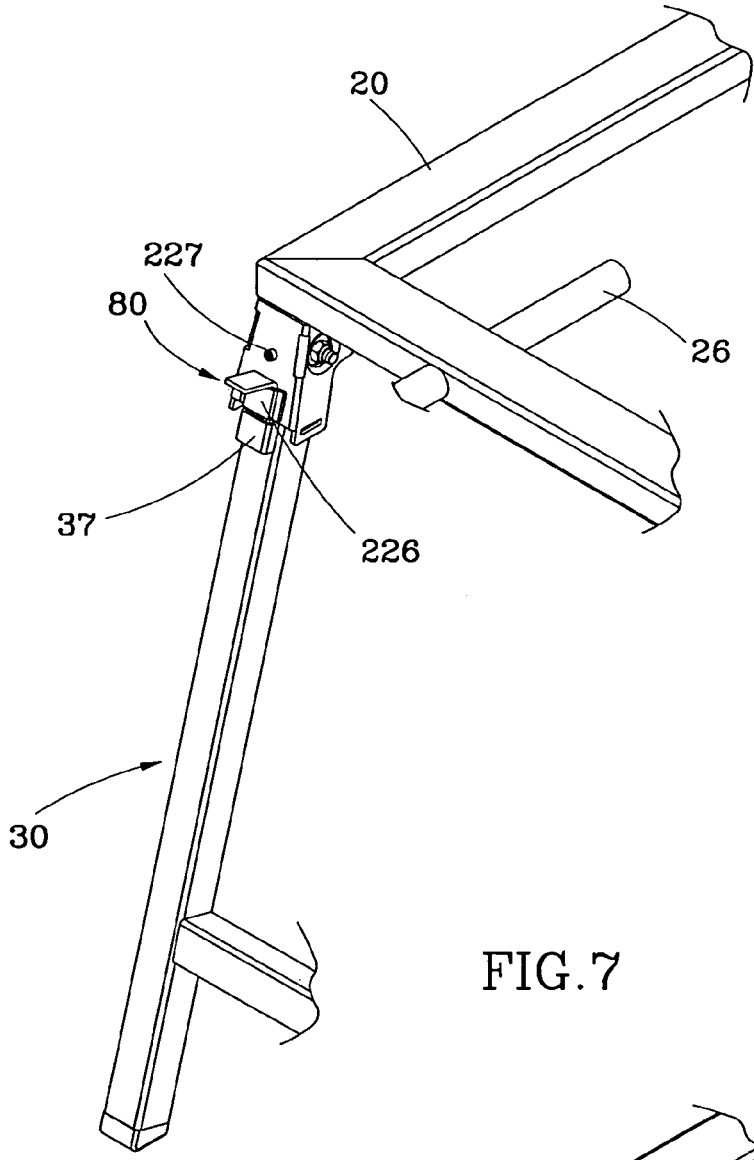
FIG. 7 is a perspective assembly view of FIG. 6 showing the leg of the first leg frame in the extended position.
Figure 8:
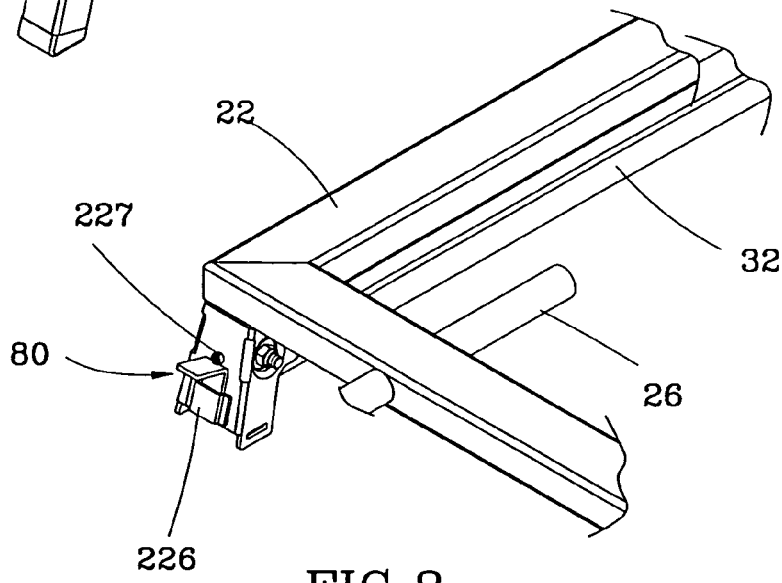
FIG. 8 is similar to FIG. 7 but showing the leg of the first leg frame in the received position.

FIGS. 6 through 8 show a foldable stand for a machine according to the second preferred embodiment of the present invention. This embodiment is substantially similar to the aforesaid first preferred embodiment; therefore like reference signs are used to indicate light members. The main features of this second embodiment are described hereinafter.

Each bracket 22 further comprises a U-shaped plate 226 fixedly fastened to the third sidewall 223 at an outer side, and a stop member 227 formed of a screw rod. The U-shaped plate 226 defines with the outer surface of the third sidewall 223 a sliding slot 228.

A U-shaped plate 37 is fasted to one vertical leg 32 of the first leg frame 30 and defines with the vertical leg 32 a receiving hole 39.

The first locking member 80 comprises a body portion 82 inserted through the sliding slot 228, a finger strip 84 perpendicularly outwardly extending from the body portion 82, and a spring leaf 86 mounted inside the sliding slot 228 and stopped against the body portion 82. The user can pull the finger strip 84 to move the body portion 82 in the sliding slot 228 and to plug the body portion 82 into the receiving hole 39 at the corresponding vertical leg 32 (see FIG. 7) to lock the first leg frame 30 in the extended position. On the contrary, the user can pull the finger strip 84 to disengage the body portion 82 from the receiving hole 39, for enabling the first leg frame 30 to be turned relative to the tabletop 20 to the received position, as shown in FIG. 8. Further, as shown in FIG. 8, the stop member 227 is in the moving path of the first locking member 80. When the user pulling the finger strip 84, the stop member 227 stops the finger strip 84 in the moving path, preventing escaping of the first locking member 80 from the sliding slot 228.

As indicated above, the locking device of the present invention is simple and ease of use. The locking members of the present invention are tough and strong for durable use. Further, because the first locking members are respectively provided in the respective receiving chambers of the brackets, they do not hurt the user accidentally.

The embodiments described above are given by way of examples only and modifications will be apparent to persons skilled in the art without departing from the scope of the invention as defined by the appended claims.

What is claimed is:

1. A foldable stand for a machine, the foldable stand comprising:

a tabletop having a plurality of brackets, said brackets each having a receiving chamber, a sliding slot, a first sidewall, a second sidewall, and a third sidewall, each of said first sidewall and said second sidewall having a sliding slot, said first, second, and said third sidewalls defining said receiving chamber, said third sidewall joining said first sidewall and said second sidewall;

a plurality of legs each having an end pivotally mounted to said tabletop such that said legs are turnable relative to said tabletop between an extended position and a received position, the end of said legs being inserted into said receiving chambers of said brackets and pivotally mounted to said brackets;

a plurality of first locking members respectively engaged in and movable along said sliding slot for stopping against said legs to lock said legs in said extended position, each of said first locking member having a body portion pivotally and movably mounted in said sliding slot of said bracket through pivot, a stop portion protruded from a periphery of said body portion, and a flat handle outwardly extended from the periphery of said body portion for pulling by a user to turn said body portion and to further force said stop portion against said leg; and a plurality of second locking members respectively engaged on said tabletop for locking said legs in said received position.

2. The foldable stand as claimed in claim 1, wherein said second locking members are hook members respectively pivotally mounted to said tabletop for hooking on said legs to lock said legs to said tabletop after said legs have been moved to said received position.

3. The foldable stand as claimed in claim 2, wherein each said leg comprises a peg for receiving said hook member.

4. The foldable stand as claimed in claim 1, wherein said second locking members are spring plates fixedly fastened to said tabletop for stopping against said legs to hold said legs in said received position.

5. The foldable stand as claimed in claim 4, wherein each said spring plate has a first end fixedly fastened to said tabletop, a second end terminating at a guiding face, and a bearing face connected between said first end and said second end and defining with said guiding face an angle; said guiding face being to guide movement of said leg toward said bearing face, said bearing face being to support said leg in said received position.

6. The foldable stand as claimed in claim 1, wherein said tabletop comprises at least one wheel and a handle provided at two opposite sides thereof for enabling a user to move the foldable stand on a floor after said legs have been locked to said tabletop in said received position.

7. A foldable stand for a machine, the foldable stand comprising:

a tabletop having a plurality of brackets, said brackets each having a receiving chamber, a sliding slot, a first sidewall, a second sidewall, a third sidewall joining said first sidewall and said second sidewall, and a U-shaped plate member affixed to an outer surface of said third sidewall and defining with said third sidewall said sliding slot, said first, second, and third sidewalls defining said receiving chamber;

a plurality of legs each having a receiving hole, an end pivotally mounted to said tabletop, whereby said legs are turnable relative to said tabletop between an extended position and a received position, and a side fixedly mounted with a U-shaped plate member, which defines with the leg the receiving hole of the leg, the ends of said legs being respectively inserted into said receiving chambers of said brackets and pivotally mounted to said brackets;

a plurality of first locking members respectively engaged in and movable along the sliding slots for stopping against said legs to lock said legs in said extended position, each of said first locking members having a body portion movably inserted into said sliding slot and engageable into the receiving hole of said leg to lock the leg in said extended position, each of said first locking members further having a spring leaf mounted in said sliding slot and stopped against the body portion of the first locking member; and a plurality of second locking members respectively engaged on said tabletop for locking said legs in said received position.

8. The foldable stand as claimed in claim 7, wherein each said first locking member further comprises a finger strip outwardly extended from the body portion of said first locking member for pulling by a user to move the first locking member in the sliding slot.

9. The foldable stand as claimed in claim 7, wherein each said bracket further comprises a stop member provided at the third sidewall thereof in a moving path of said first locking member to prohibit the first locking member from escaping out of said sliding slot.

10. The foldable stand as claimed in claim 7, wherein said second locking members are hook members respectively pivotally mounted to said tabletop for hooking on said legs to lock said legs to said tabletop after said legs have been moved to said received position.

11. The foldable stand as claimed in claim 10, wherein each said leg comprises a peg for receiving said hook member.

12. The foldable stand as claimed in claim 7, wherein said second locking members are spring plates fixedly fastened to said tabletop for stopping against said legs to hold said legs in said received position.

13. The foldable stand as claimed in claim 12, wherein each said spring plate has a first end fixedly fastened to said tabletop, a second end terminating at a guiding face, and a bearing face connected between said first end and said second end and defining with said guiding face an angle; said guiding face being to guide movement of said leg toward said bearing face, said bearing face being to support said leg in said received position.

14. The foldable stand as claimed in claim 7, wherein said tabletop comprises at least one wheel and a handle provided at two opposite sides thereof for enabling a user to move the foldable stand on a floor after said legs have been locked to said tabletop in said received position.

15. A foldable stand for a machine, the foldable stand comprising:

a tabletop;

a plurality of legs each having an end pivotally mounted to said tabletop such that said legs are turnable relative to said tabletop between an extended position and a received position;

a plurality of first locking members respectively movably engaged to said tabletop for stopping against said legs to lock said legs in said extended position; and a plurality of second locking members respectively engaged to said tabletop for locking said legs in said received position, wherein said second locking members are spring plates fixedly fastened to said tabletop for stopping against said legs to hold said legs in said received position, and each of said spring plate has a first end fixedly fastened to said tabletop, a second end terminating at a guiding face, and a bearing face connected between said first end and said second end and defining with said guiding face an angle, said guiding face being to guide movement of said leg toward said bearing face, said bearing face being to support said leg in said received position.

16. The foldable stand as claimed in claim 15, wherein said tabletop comprises a plurality of brackets, each of which has a receiving chamber and a sliding slot; said first locking members are movable along said sliding slots for stopping against said legs, the ends of said legs respectively being inserted into said receiving chambers of said brackets and pivotally mounted to said brackets; said brackets each has a first sidewall, a second sidewall, and a third sidewall joining said first sidewall and said second sidewall, each of said first and said second sidewalls having a sliding slot, said first, second, and third sidewalls defining said receiving chamber.

17. The foldable stand as claimed in claim 16, wherein said first locking member comprises a body portion pivotally and movably mounted in said sliding slot of said bracket through a pivot, a stop portion protruded from a periphery of said body portion, and a flat handle outwardly extended from the periphery of said body portion for pulling by a user to turn said body portion and to further force said stop portion against said leg.

18. The foldable stand as claimed in claim 15, wherein said brackets each have a first sidewall, a second sidewall, a third sidewall joining said first sidewall and said second sidewall, and a U-shaped plate member affixed to an outer surface of said third sidewall and defining with said third sidewall said sliding slot, said first, second, and third sidewalls defining said receiving chamber; each of said legs has a receiving hole and a side fixedly mounted with a U-shaped plate member, which defines with the leg said receiving hole; each of said first locking members has a body portion movably inserted into said sliding slot of said bracket and engageable into said receiving hole of said leg to lock the leg in said extended position.

19. The foldable stand as claimed in claim 18, wherein each said first locking member further comprises a spring leaf mounted in said sliding slot of said bracket and stopped against the body portion of the first locking member.

20. The foldable stand as claimed in claim 18, wherein each said first locking member further comprises a finger strip outwardly extended from the body portion of said first locking member for pulling by a user to move the first locking member in said sliding slot of said bracket.

21. The foldable stand as claimed in claim 18, wherein each said bracket further comprises a stop member provided at the third sidewall thereof in a moving path of said first locking member to prohibit the first locking member from escaping out of said sliding slot.

* * * * *